United States Patent [19]

Keisling

[11] 4,047,322

[45] Sept. 13, 1977

[54] AMUSEMENT DEVICE OF PICTORIAL DISPLAY

[75] Inventor: Nelson Woodrow Keisling, Racine, Wis.

[73] Assignees: James Stephen Holub; Robert James LaSalle, both of Racine, Wis. ; part interest to each

[21] Appl. No.: 658,176

[22] Filed: Feb. 17, 1976

[51] Int. Cl.[2] ..... A63H 33/00

[52] U.S. Cl. ..... 46/1 R; 35/69

[58] Field of Search ..... 46/1 R, 23; 35/23, 26, 35/69; 273/86 R

[56] References Cited

U.S. PATENT DOCUMENTS

| | | | |
|---|---|---|---|
| 2,747,298 | 5/1956 | Sullivan | 35/26 |
| 2,776,835 | 1/1957 | Wilson | 273/86 R |
| 3,866,338 | 2/1975 | Lou | 35/69 |

*Primary Examiner*—John F. Pitrelli
*Assistant Examiner*—Robert F. Cutting
*Attorney, Agent, or Firm*—Arthur J. Hansmann

[57] ABSTRACT

An amusement device of pictorial display including a base member with markings thereon depicting an object and with the markings being located in rows for identifying locations of elongated blocks which are standable on end along the rows. The blocks can be tipped in the direction of their rows and thereby sequentially knock each other over and form rows of blocks laying on each other to thereby present a three-dimensional display of the object depicted on the base member.

2 Claims, 3 Drawing Figures

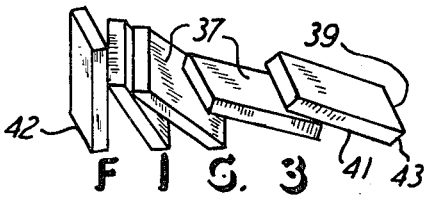
FIG. 3
FIG. 1
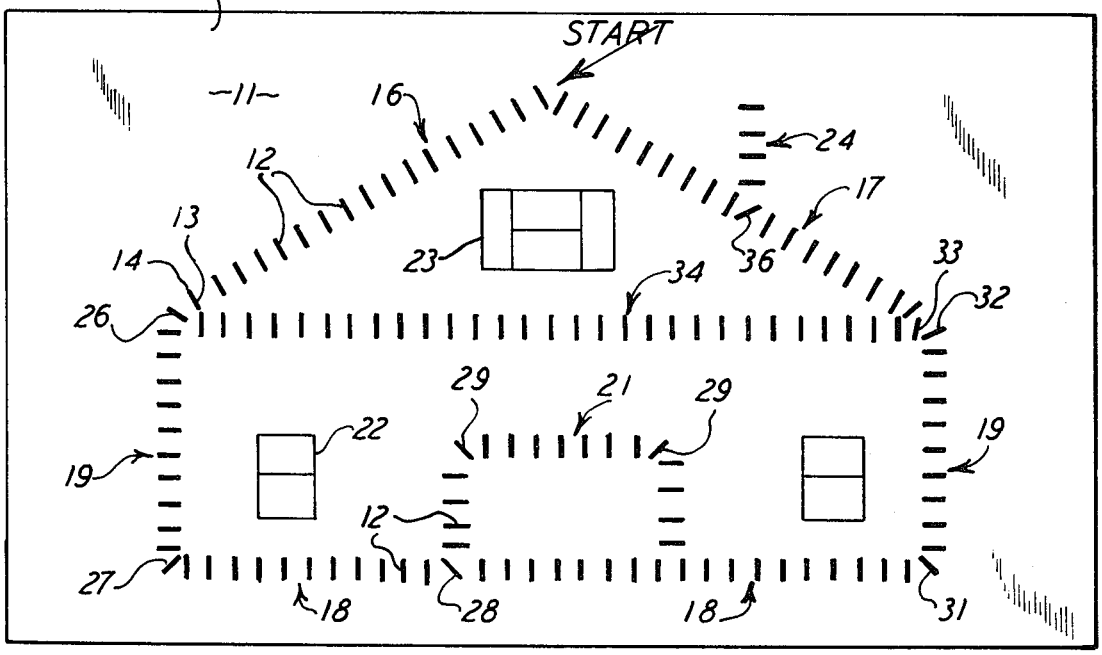
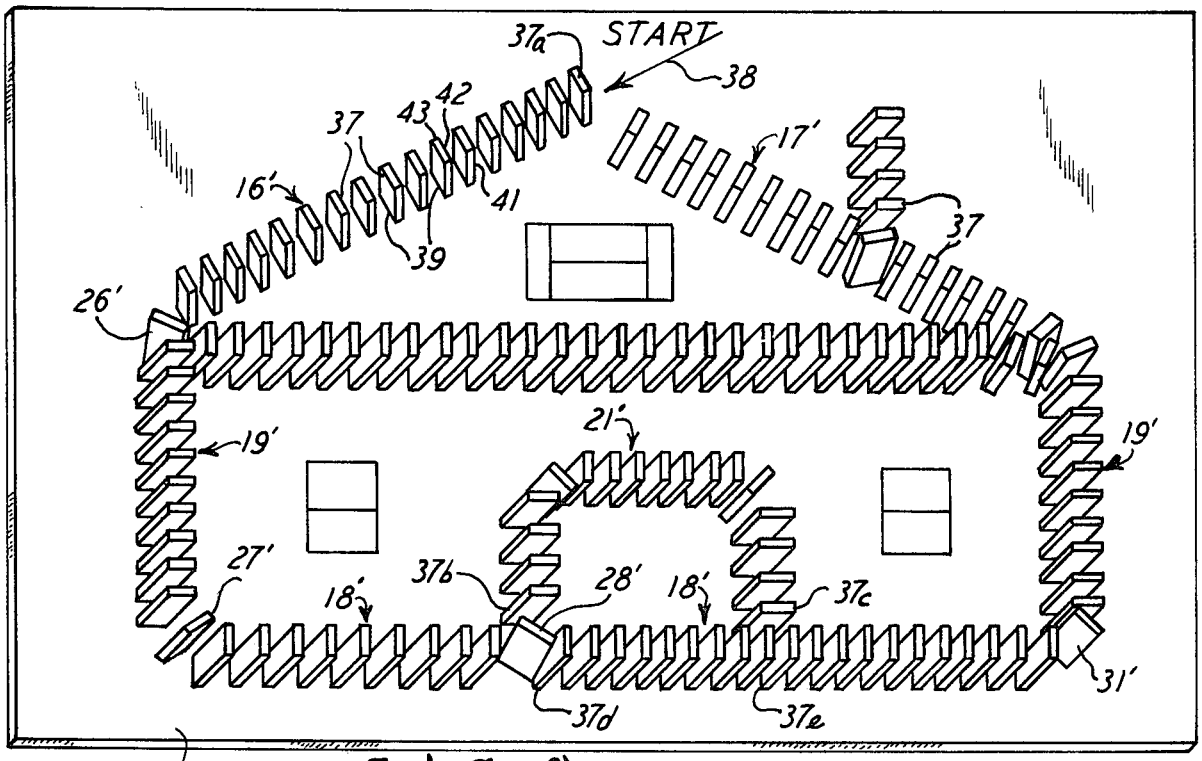
FIG. 2

AMUSEMENT DEVICE OF PICTORIAL DISPLAY

This invention relates of an amusement device of pictorial design, and, more particularly, it relates to an amusement device which utilizes blocks which are disposed in a row and which can be tipped toward each other to sequentially knock each other down along the row and thereby reveal the object dipicted on a base member supporting the blocks.

BACKGROUND OF THE INVENTION

The prior art is already aware of amusement devices which utilize blocks or three-dimensional objects which can be disposed on a base member or sheet and thereby depict an object on the sheet. These three-dimensional objects are known to have been disposed on the sheet in an overlapped or imbricated form to depict the object on the sheet, and one isolated example of such prior art is seen in U.S. Pat. No. 2,747,298 where colored sticks are laid in rows which depict an object on a sheet; and another example is seen in U.S. Pat. No. 2,937,931. Also, U.S. Pat. No. 3,866,338 discloses the utilization of elongated blocks which can be tipped against each other and thereby recline in positions supported by each other, but this is for a purpose substantially different from that disclosed in the present document.

In the present invention, the amusement device is provided by having a base member or sheet with an object depicted thereon by means of rows of markings over which elongated blocks can be positioned, and the blocks can than be tipped one against the other to complete the rows in a three-dimensional presentation and thereby show the object on the base member or sheet. Accordingly, the present invention provides an amusement device and an educational device in that the object printed on the sheet can be that of a certain construction, such as of a building, or it can be certain words which a child can observe and learn the spelling and meaning thereof by means of following the procedures for utilizing this particular amusement device Within the context of the aforementioned, the amusement device of this invention can be used for educational purposes of teaching a child the meaning of words, the spelling of words, simple arithmetic principles, teaching constructions and configurations of objects and geometric designs, and many other like teaching principles are possible with this invention, as well as providing amusement and even a game type of challenge. Still further, this device can be utilized for developing the coordination and so-called motor skills of a person, particularly a child, and it can be used to stimulate and explore creativity and to develop patience of the user.

Still further, the aforementioned objectives, and other objectives and accomplishments which will be apparent to one reading the present document, are all accomplished by means of simplified and inexpensive equipment, and equipment which is sufficiently attractive and durable for the purpose of use by a child and for endless reuse without wear or deterioration of the equipment.

Other objects and advantages will become apparent upon reading the following description in light of the accompanying drawings.

BRIEF DESCRIPTION OF THE DRAWINGS

FIG. 1 is a top plan view of a sheet showing markings thereon displaying an object on the sheet.

FIG. 2 is a top perspective view of the sheet of FIG. 1, slightly enlarged, and with tippable blocks disposed on the sheet at the locations of the markings.

FIG. 3 is an enlarged perspective view of several of the blocks shown in FIG. 2, and with the blocks shown in the tipping condition.

DETAILED DESCRIPTION OF THE PREFERRED EMBODIMENT

FIGS. 1 and 2 show a base member 10 which is in the form of a sheet which may be a game board or the like, and the sheet is shown to be of a rectangular plan configuration and relatively thin, as seen in FIG. 2. The top face 11 of the base member 10 has a building structure depicted thereon in front elevational view by means of markings 12 disposed in rows and the like on the face 11. That is, the markings 12 are indicated to be printings or other indicia on the face 11 and are shown to be generally of a rectangular configuration having a length dimension indicated at 13 and a width dimension indicated at 14, and thus the markings 12 are elongated and of the rectangular configuration shown and described. Further, the markings 12 are disposed in lines or rows, such as the angulated rows 16 and 17 which depict a roof of the building shown, and the rows designated 18 and 19, respectively depict the building floor line and side walls, and the inverted U-shaped row 21 depicts a porch or front entrance to the building configuration. Also, lines 22 and 23 are indicia provided on the face 11, such as printing thereon, and these lines 22 and 23 depict windows in the building shown. Still further, the marking row 24 depicts chimney for the building shown.

It will therefore be seen and understood that the sheet 10 has the markings 12 provided thereon, and the markings are shown in the rows, such as the rows specifically referred to, and the markings are spaced apart a certain distance, for a purpose hereinafter referred to. Also, it will be seen that the rows have so-called intersecting markings, such as the marking 26 at the intersection or juncture between the rows 16 and 19; the marking 27 between rows 19 and 18; the marking 28 between rows 18 and 21; the markings 29 within the rows 21; the marking 31 between the rows 18 and 19; the markings 32 and 33 between the rows 19 and 17 and a row designated 34; and the marking 36 in the row 17 and directed toward the row 24.

FIG. 2 shows the sheet 10 with unstable, elongated blocks 37 upstanding on the sheet 10 and with a block 37 disposed on each of the markings 12. Thus the blocks 37 also generally show the outline of the building construction as it is shown by the markings 12 of FIG. 1. Also, FIGS. 1 and 2 show the word "START" with the arrow designated 38 pointing along the length of the row 16, and this is for the purpose of showing the user where the first of the tippable blocks 37 will be tipped toward its adjacent block and thereby position the blocks in the reclined or prone position as they sequentially tumble or tip against each other. That is, the blocks 37 are elongated and have a fairly narow base designated 39 in FIGS. 2 and 3, and of course the base is of a rectangular configuration like the markings 12, and thus the blocks cover the markings 12, as shown in FIG. 2. The blocks are also of a dimension to have a height designated 41 which is the largest dimension of the blocks, and the blocks also have a width designated 42 and a narrow thickness designated 43. With that configuration of the blocks 37, the blocks can be positioned on the markings 12 and thereby form the respective rows described, such as the rows 16', 17', 18', and the rest.

As mentioned, the so-called first block, designated 37*a*, can be tipped in the direction indicated by the arrow 38, and that block will fall against the adjacent block 37 and thus the entire row 16' will tumble, as indicated in FIG. 3, and the intersection block 26' will finally be tipped by the last block 37 in the row 16', and, due to the angulation of the intersection block 26', the block 26' will fall in the general direction of the row 19' and will thus cause the entire row 19' to sequentially tumble. Continuously, each successive row along the sequential path of the blocks 37 will tumble, and the intersection block 27' will tumble when all of the blocks in the row 19' are down and then the block 27' will tumble against the first block in the lower row 18'. In this manner, there is a sequence of tipping or tumbling of the blocks 37, commencing with the first block 37*a* and continuing in a chain reaction throughout all of the blocks and along the row 18', as mentioned until the intersection block 28' is tipped, and that will cause the blocks in the inverted U-shaped row 21' to tip from a first block 37*b* in row 21' and to the last block 37*c* in the row 21'. At the same time, the block 28' was angulated at the orientation shown, and the block therefore tumbled against the remainder of the row 18' to the right of the block 28' until the block 31' was engaged and thus the rows 19', 17', 34', and 24' were sequentially tipped.

Therefore, the intersection blocks, such as blocks 27' and 28', for instance, are disposed at appropriate angles for bisecting the rows which are immediately adjacent the intersecting blocks, and thus the blocks 27' and 28' are at 45° with respect to the length of the rows 19' and 18', for instance.

It should also be understood that while the blocks are falling in sequence and essentially one-by-one from the location "START" and back to approximately that location, as described, the arrangement of the blocks of FIG. 2 shows that there will be two or more rows of blocks falling or tipping simultaneously. That is, when the block 28' engages the block 37*b*, the U-shaped row 21' will fall while the remainder of the row 18' to the right of block 28' continues to fall. However, in order to avoid having the block 37*c* fall against the blocks 37 in the row 18' before the remainder of the blocks in row 18' fall or are tipped, the row 21' is of a longer length than is the length of the row 18' between the block 37*d* and the block 37*e* in row 18'. Therefore, the block 37*e* is caused to fall to the right, by virtue of the sequential tumbling of the blocks along row 18', rather than have it fall forward relative to the FIG. 2 showing and which would be cause if block 37*c* engaged block 37*e* before block 37*e* is tipped through the action in the line 18'.

Also, the blocks standing on the markings 32 and 33 are thus sufficiently angulated or oriented so that the tipping of the block on the marking 31 will cause the tipping of the row 19' and the blocks on the markings 32 and 33 will subsequently cause the tipping of the blocks along the rows 17' and 34', and that tipping will be a simultaneous action along those two rows to enhance the speed and interest and attractiveness of the use of the device described herein.

Accordingly, the spacing between the markings 12 is less thanthe uniform length 41 of the blocks 37, and thus FIG. 3 shows several of the blocks 37 in the tipped form and it will be seen that they assume a shingled or imbricated position when fully tipped and the blocks therefore lean on each other to provide a good three-dimensional view of the object depicted on the base member 10. Also, the inverted U-shaped row 21' is referred to as a branch and its total length is greater than the length of the portion of the row 18' intersected by or adjacent to the end blocks 37*b* and 37*c* in row 21', for the purpose of initially tipping the block 37*e* in the action along row 18' prior to tipping the block 37*c*, for the purpose mentioned above. Also, it will be understood that the object displayed or depicted on the sheet 10 can be a word or it can be numbers identified or outlined by the markings 12, so that the user or player can position blocks 37 over those markings 12 forming the letters, words, or numbers, or any other geometric design or configurtion, all within the understanding and context of the actual showing of the one required embodiment shown in FIGS. 1 and 2 where a building structure is depicted.

Also, FIG. 2 shows that the blocks 37 in row 18' and to the left of the block 28' are spaced apart a distance greater than the spacing of the blocks 37 in the row 18' and to the right of the block 28', and it of course would be understood that the spacing of the markings 12 in FIG. 1 would be of that arrangement. Accordingly, the blocks in the row 18' and to the left of the block 28' will fall slower than the blocks in row 18' and to the right of the block 28'. This arrangement therefore gives a different falling action for both the viewing and the sound of the falling or tipping blocks. That is, the blocks in the right-hand end of row 18', as viewed in FIG. 2, will fall faster and will give the different viewing effect and the different sound. Further, the differences just described in connection with the two ends of row 18', and the action of the tipping or falling blocks in all the other rows and positions are such that there is an intrigue and attraction in the sequentially tipping blocks and in the sound made by the falling of one block against the neighboring block. As such, variation and intrigue and amusement is added to the entire arrangement.

Also, the blocks 37 could be of different colors, and one could arrange them by color or alternate colors, to enhance the effect of the falling blocks and to show the color when the blocks have fallen and permit creation of colored designs or pictures.

What is claimed is:

1. An amusement device of pictorial display, comprising a base member having markings thereon depicting an object, said markings being located on said member in rows representing the configuration of said object, said markings being spaced apart relative to each other in directions relative to the length of said rows of said markings, said markings having length and width dimensions and being oriented relative to said rows to have the length dimension disposed transverse to the length of its said row, said markings being located in said rows which intersect with each other, one of said markings at the intersection of said rows having an orientation with its said length dimension which bisects the intersection of the lengths of said intersecting rows, one of said intersecting rows of said markings being arranged as a branch which extends from said intersection with another of said intersecting rows and which re-intersects said another row at a location spaced along said another row, a plurality of elongated blocks disposed spaced apart and on end and singularly on each of said markings with the longest dimension of said blocks being upright and with said blocks being presented along said rows of and at the orientations of said markings, said blocks have a rectangular base having length and width dimensions matching said dimensions of said markings and with the said length dimension of said blocks being orientated with said length dimension of said markings to have said base of said blocks disposed transverse to said rows, said blocks being tipable in the direction along their said rows and being of an elongated height sufficient to lean against each other in the tipped position and while on said markings to thereby create a sequential falling action and ultimately prone align along said rows of said markings, the total length of said branch row being greater than the length of said another row from said intersection o the stated re-intersection, to thereby have said blocks in said length of said another row tip over before all said blocks in said branch row tip over, and said base member having indicia thereon showing which one of said blocks is to be first tipped toward the others.

2. The amusement device of pictorial display as claimed in claim 1, and wherein said markings and said blocks in said another row are spaced apart at one distance, and said markings and said blocks in said branch row are spaced apart at a spacing greater than said one distance, whereby said blocks in said another row fall against the adjacent block in a time interval less than the corresponding falling of said blocks in said branch row.

* * * * *

UNITED STATES PATENT OFFICE

CERTIFICATE OF CORRECTION

PATENT NO. : 4,047,322

DATED : September 13, 1977

INVENTOR(S) : Nelson W. Keisling

It is certified that error appears in the above-identified patent and that said Letters Patent are hereby corrected as shown below:

Column 5, line 12, change "o" to--to--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*